US005397218A

United States Patent [19]

Fujii et al.

[11] Patent Number: 5,397,218

[45] Date of Patent: Mar. 14, 1995

[54] SUPPORT MECHANISM FOR A ROTARY SHAFT USED IN A SWASH PLATE TYPE COMPRESSOR

[75] Inventors: Toshiro Fujii; Koichi Ito; Kazuaki Iwama; Hitoshi Inukai, all of Kariya, Japan

[73] Assignee: Kabushiki Kaisha Toyoda Jidoshokki Seisakusho, Kariya, Japan

[21] Appl. No.: 102,588

[22] Filed: Aug. 5, 1993

Related U.S. Application Data

[63] Continuation-in-part of Ser. No. 101,927, Aug. 4, 1993, Pat. No. 5,368,450, which is a continuation-in-part of Ser. No. 101,178, Aug. 3, 1993.

[30] Foreign Application Priority Data

Aug. 7, 1992 [JP] Japan ..... 4-211164
Sep. 18, 1992 [JP] Japan ..... 4-250141

[51] Int. Cl.[6] ..... F04B 1/12; F01B 3/00

[52] U.S. Cl. ..... 417/269; 91/480; 91/499; 91/502; 92/71

[58] Field of Search ..... 417/269; 91/499, 502, 91/480; 92/71

[56] References Cited

U.S. PATENT DOCUMENTS

| | | | |
|---|---|---|---|
| 1,367,914 | 2/1921 | Larsson . | |
| 2,016,802 | 10/1935 | Fick . | |
| 2,671,606 | 3/1954 | Ricardo . | |
| 3,356,080 | 12/1967 | Howard . | |
| 3,514,221 | 5/1970 | Hasquenoph et al. . | |
| 3,734,647 | 5/1973 | Sparks . | |
| 4,326,838 | 4/1982 | Kawashima et al. | 417/269 |
| 4,360,321 | 11/1982 | Copp, Jr. et al. | 417/269 |
| 4,475,443 | 10/1984 | Forster | 91/499 |
| 4,880,360 | 11/1989 | Terauchi et al. | 417/269 |
| 5,017,095 | 5/1991 | Burgess et al. | 417/269 |
| 5,076,764 | 12/1991 | Kawai et al. . | |
| 5,232,349 | 8/1993 | Kimura et al. | 417/269 |
| 5,252,032 | 10/1993 | Iwanami et al. | 417/269 |

FOREIGN PATENT DOCUMENTS

| | | |
|---|---|---|
| 0438055 | 7/1991 | European Pat. Off. . |
| 0447027 | 9/1991 | European Pat. Off. . |
| 923985 | 2/1955 | Germany . |
| 1703528 | 10/1973 | Germany . |
| 1326307 | 12/1979 | Germany . |
| 3823859 | 4/1990 | Germany . |
| 350135 | 3/1992 | Germany . |
| 196478 | 4/1989 | Japan . |
| 3-92587 | 4/1991 | Japan . |
| 1433440 | 4/1976 | United Kingdom . |

*Primary Examiner*—Richard A. Bertsch
*Assistant Examiner*—Howard R. Richman
*Attorney, Agent, or Firm*—Brooks Haidt Haffner & Delahunty

[57] ABSTRACT

A swash plate type compressor is disclosed. A swash plate mounted on a rotary shaft reciprocally drives a double headed piston in cylinder bores. The rotary shaft is supported by valve plates, via a pair of tapered roller bearings. Outer races of the bearings are slidably fitted into sleeves, respectively. A disc spring disposed between protrusions for holding a front housing and the outer race is resiliently deformed for applying a preload to the rotary shaft. Protrusions for holding a rear housing abut against the outer race. Cylinder blocks, valve plates and housings are tightly connected one to another by a plurality of through bolts.

12 Claims, 10 Drawing Sheets

SUPPORT MECHANISM FOR A ROTARY SHAFT USED IN A SWASH PLATE TYPE COMPRESSOR

This application is a continuation-in-part of Ser. No. 08/101,927, filed Aug. 4, 1993, now U.S. Pat. No. 5,368,450, which is a continuation-in-part of Ser. No. 08/101,178, filed Aug. 3, 1993.

BACKGROUND OF THE INVENTION

1. Field of the Invention

The present invention relates to a swash plate type compressor used for vehicular air conditioning. More particularly, it relates to an improvement of a mechanism for a rotary shaft of the compressor.

2. Description of the Related Art

Japanese Unexamined Patent Publication No. 3-92587 discloses a conventional swash plate type compressor. As shown in FIG. 11, this compressor described in the above-described publication includes a pair of opposed cylinder blocks 100 and 101. A plurality of cylinder bores 102 and 103 are formed within the cylinder blocks 100 and 101 (only one pair shown). Cylinder bores 102 and 103 are equiangularly disposed around a rotary shaft 105 which supports a swash plate 104. Double headed pistons 106 are accommodated in the paired cylinder bores 102 and 103. Compression chambers 107 and 108 are defined at the side surfaces of the piston 106, respectively. The compression chambers 107 and 108 communicate with discharge chambers 109 and 110, via discharge ports 113 and 114, respectively. Discharge valves 117 and 118 open or close the associate discharge ports 113 and 114, respectively. When the piston 106 is in the compression stroke, refrigerant gas in the compression chambers urges the discharge valves 117 and 118 away, so as to be discharged into the discharge chambers 109 and 110.

The compression chambers 107 and 108 communicate with suction chambers 111 and 112, via suction ports 115 and 116, respectively. Suction valves 119 and 120 open or close the associated suction ports 115 and 116, respectively. When the piston 106 is in the suction stroke, the refrigerant gas in the suction chambers 111 and 112 is sucked into the compression chambers 107 and 108 while the gas is urging the suction valves 119 and 120 away.

The rotary shaft 105 is supported by means of the paired cylinder blocks 100 and 101, via a pair of radial bearings 121 and 122, respectively. A pair of thrust bearings 123 and 124 are disposed between the swash plate 104 and cylinder block 100, and between the swash plate 104 and the cylinder block 101, in such a manner that the swash plate 104 is clamped by the bearings 123 and 124. Therefore, radial load acting on the shaft 105 is received by the cylinder blocks 100 and 101, via the radial bearings 121 and 122. Thrust load acting on the shaft 105 is received by the cylinder blocks 100 and 101, via the bearings 123 and 124.

When the compressor is provided with five pistons, the thrust load acting on the rotary shaft varies along a curve CU0 shown in FIG. 12. A maximum value Fmax and a minimum value negative Fmax will appear five times each while the shaft makes one revolution. In other words, the thrust load acts five times forwardly and five times rearwardly with respect to the swash plate. The shaft 105 and cylinder blocks 100 and 101 are designed with tolerances. The direction conversion of the thrust load generates lash along the shaft 105, causing noise and vibration.

However, as the pair of cylinder blocks 100 and 101 are connected, a pair of races clamping the rollers of the thrust bearings 123 and 124 are deflected beforehand. The force originated in this deformation acts as a preload on the shaft 105. The magnitude of deformation is designed so that the resultant preload exceeds the maximum value. As the magnitude of preload is determined in this manner, the generation of lash is eliminated, resulting in a successful suppression of the noise and vibration.

However, the support mechanism of the above rotary shaft includes the radial bearings 121 and 122, and thrust bearings 123 and 124, which are disposed at separate positions, and which receive the radial and thrust loads both applied on the shaft 105. This complicates the operational steps of assembling the compressor.

There is a type of compressor having a rotary shaft made of steel iron, and cylinder blocks made of aluminum to lighten the weight. The above rotary shaft support mechanism employed in this compressor causes the thermal expansion coefficient of cylinder blocks different from that of rotary shaft. Therefore, the magnitude deviation in the thermal expansion between the cylinder blocks and rotary shaft is generated due to the temperature variation of discharged refrigerant gas. Consequently, the relative connected condition between the cylinder blocks and rotary shaft varies. As a result, the undesirable preload is applied on the rotary shaft.

More specifically, the temperature of the compressor increases according to the temperature of discharged refrigerant gas when the compressor is operated in the state of high compression ratio. Therefore, the magnitude of thermal expansion of cylinder blocks, and front and rear housings along the thrust direction becomes larger than that of the rotary shaft along the same direction. Accordingly, the compressor has a high compression ratio, resulting in the largest thrust load applied on the rotary shaft. However, the preload becomes smaller than that of thrust load. Resultingly, lash is generated along the rotary shaft. There will be new drawbacks in which the noise and vibration are generated.

According to the light weight compressor, a preload will be set rather large with consideration of thermal influence. When the compressor is operated with a low compression ratio, the temperature of discharged refrigerant gas is low. The internal temperature of compression chambers is thus low. Therefore, the thermal expansion along the thrust direction of the cylinder blocks, and front and rear housings is small. Accordingly, the preload applied to the rotary shaft is large. As a result, there is a drawback in which the power loss is increased when the rotary shaft is to be rotated.

SUMMARY OF THE INVENTION

It is a primary object of the present invention to provide a support mechanism for a rotary shaft in a swash plate type compressor, which is assembled through a simple process and operated with little noise and vibration. Relating to this object, it is an object of the present invention to provide a support mechanism which has a single bearing member capable of receiving a radial load and a thrust load both applied to a rotary shaft, and a spring for applying a preferable preload on the rotary shaft.

It is another object of the present invention to provide a support mechanism for a rotary shaft in a swash plate type compressor, which is able to control the increase of power loss by applying a preferable preload to the rotary shaft along the direction of the thrust, when the compressor is operated with a high compression ratio.

In order to achieve the above objects, a compressor of the present invention has paired bores in a cylinder block, a swash plate mounted on a rotary shaft and double headed type pistons operably connected with the swash plate, each piston having a pair of piston heads for compressing refrigerant gas by reciprocating motion in said bores in accordance with rotation of said swash plate. The compressor comprises bearing means mounted on said rotary shaft to rotatably support the rotary shaft, the bearing means being arranged to receive a radial load generated on the rotary shaft in accordance with the rotation of the rotary shaft, and a thrust load applied to the rotary shaft by the compressed gas by way of the piston heads. The compressor further includes means for supporting the bearing means in the slidable manner in the axial direction in respect with the rotary shaft and spring means for applying a preload to the rotary shaft, by way of said bearing means, in the axial direction thereof.

BRIEF DESCRIPTION OF THE DRAWINGS

The invention, together with objects and advantages thereof, may best be understood by reference to the following description of the presently preferred embodiments together with the accompanying drawings, in which.

DESCRIPTION OF THE PREFERRED EMBODIMENTS

The first embodiment according to the present invention will now be described, referring to FIGS. 1 through 7.

Figure 1:
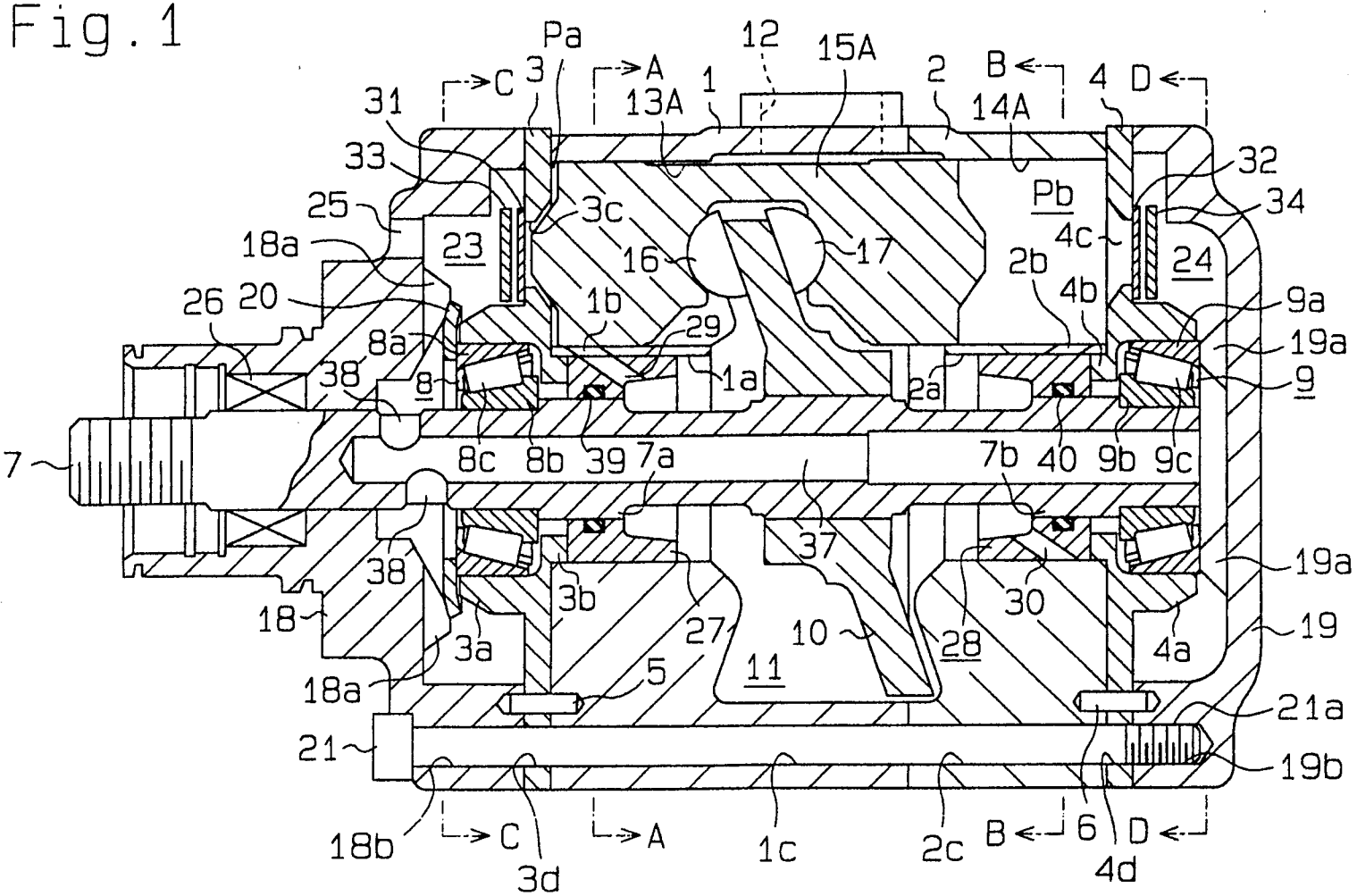
FIG. 1 is a cross sectional view illustrating a swash plate type compressor according to the first embodiment of the present invention.

As shown in FIG. 1, a swash plate type compressor according to the present embodiment includes a front and rear cylinder blocks 1 and 2, which are connected to each other. Accommodating bores 1*a* and 2*a* are formed at the central portion of the blocks 1 and 2, respectively. Valve plates 3 and 4 are secured to the end surfaces of the blocks 1 and 2, respectively. The plates 3 and 4 include cylindrical sleeves 3*a* and 4*a* and sleeves 3*b* and 4*b* in the central portion of the compressor, which are projecting outward and inward, respectively. The sleeves 3*b* and 4*b* are fitted into the acceptor bores 1*a* and 2*a*, respectively. Pins 5 and 6 are inserted through the blocks 1 and 2, and plates 3 and 4, respectively. The pins 5 and 6 restrict relative rotations between the block 1 and plate 3, and block 2 and plates 4.

A rotary shaft 7 is supported by means of the sleeves 3*a* and 4*a*, via tapered roller bearings 8 and 9. Outer races 8*a* and 9*a* of the bearings 8 and 9 are slidably received in the sleeves 3*a* and 4*a*, respectively. Inner races 8*b* and 9*b* abut against the distal surfaces of step portions 7*a* and 7*b* which are formed on the rotary shaft 7, respectively. Each of the inner races 8*b* and 9*b* is immovably supported by the associate step portion. Rollers 8*c* and 9*c* are disposed between the outer races 8*a* and 9*a*, and inner races 8*b* and 9*b*, respectively. The axes of rollers 8*c* and 9*c* are inclined with respect to the axis of the shaft 7. The rollers 8*c* and 9*c* rotate around the side surfaces of circular truncated cones, respectively. The larger diameter sides of each circular truncated cone confront each other.

Crank case 11 is formed in the cylinder blocks 1 and 2, respectively. A swash plate 10 is securely mounted on the shaft 7 in the crank case 11. The crank case 11 communicates with an external suction passage (not shown) for the refrigerant gas, via suction port 12.

Figure 2:
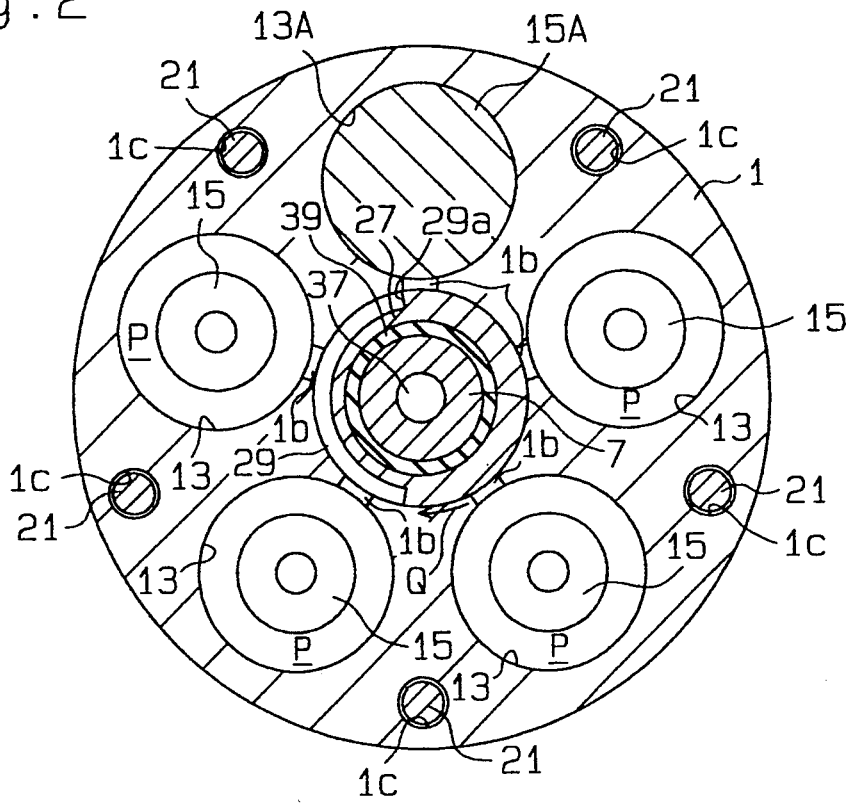
FIG. 2 is a cross sectional view taken along line A—A of FIG. 1.
Figure 3:
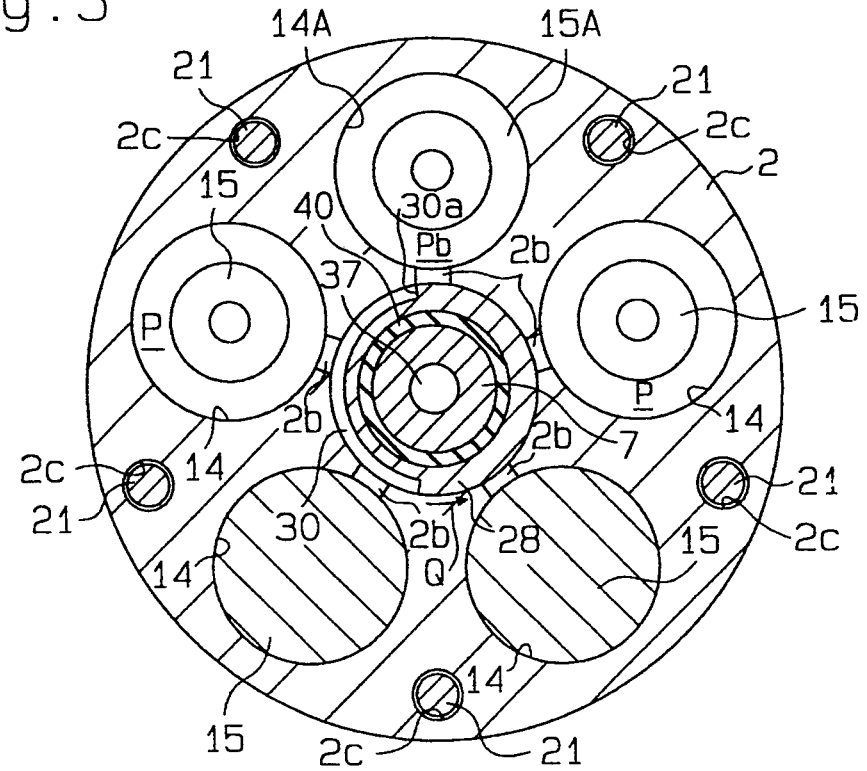
FIG. 3 is a cross sectional view taken along line B—B of FIG. 1.

As shown in FIGS. 2 and 3, a plurality of cylinder bores 13, 13A and 14, 14A are formed in the blocks 1 and 2. The bores 13, 13A and 14, 14A are equiangularly disposed around the shaft 7 at equidistant intervals (i.e., five pairs of bores in this embodiment). As shown in FIG. 1, piston heads 15 and 15A are reciprocally movable in the associated bores which are paired and formed with the bores 13 and 14, and 13A and 14A, respectively. Front and rear compression chambers Pa and Pb are defined in the bores 13 and 14, and 13A and 14A by the piston heads 15 and 15A, respectively. Semispherically shaped shoes 16 and 17 are disposed between both surfaces of swash plate 10 and piston heads 15 and 15A, respectively. Accordingly, the pistons 15 and 15A reciprocate in the paired bores 13 and 14, and 13A and 14A, respectively, as the swash plate 10 rotates.

Figure 4:
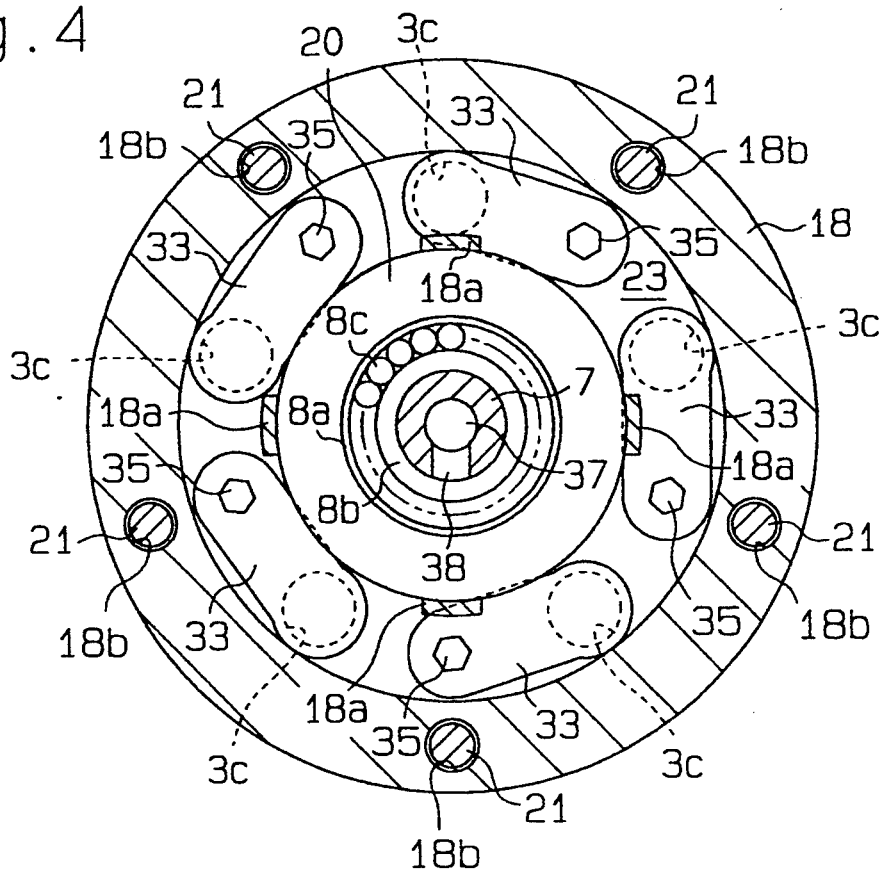
FIG. 4 is a cross sectional view taken along line C—C of FIG. 1.
Figure 5:
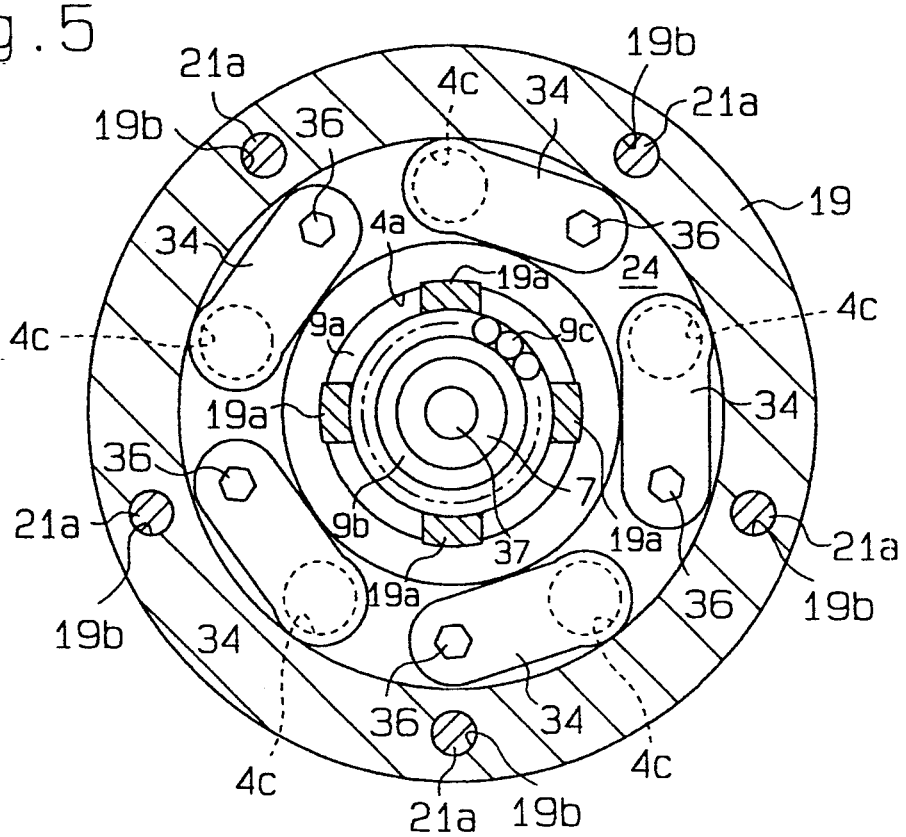
FIG. 5 is a cross-sectional view taken along line D—D of FIG. 1.

A front housing 18 is connected with the distal surface of the plate 3. A rear housing 19 is connected with the distal surface of the plate 4. As shown in FIGS. 4 and 5, a plurality of projections 18*a* and 19*a* are circularly disposed in inner peripheral surfaces of the housings 18 and 19, respectively.

A disc spring 20 for applying a preload to the rotary shaft has a ring shape. As shown in FIG. 1, the spring 20 is disposed between the projections 18*a* and the outer race 8*a* of the bearing 8. The peripheral edge portions of the spring 20 are fitted into the associate gaps between the projections 18*a*. The spring 20 is supported with respect to the front housing 18 in an unmovable manner due to this fitting arrangement. The inner peripheral edge portion of the spring 20 abuts against the distal surface of the outer race 8*a* of the bearing 8. The distal surface of the outer race 8*a* of the bearing 8 protrudes outward beyond the end surface of the sleeve 3*a*. The protrusion 19*a* abuts against the end surface of the outer race 9*a* of the bearing 9.

Therefore, the thrust load acting on the shaft 7 in the direction from the front housing 18 to the rear housing 19 is received by the rear housing 19, via the bearing 9. Further, the thrust load acting reversely on the shaft 7 is received by the front housing 18, via the bearing 8 and the disc spring 20.

A plurality of through bolts 21 (five bolts in this embodiment) securely unite the blocks 1 and 2, valve plates 3 and 4, front and rear housings 18 and 19. The bolts 21 are inserted into guide holes 1*c*, 2*c*, 3*d*, 4*d*, and 18*b* formed in the parts 1, 2, 3, 4 and 18, respectively. Threaded portions 21*a* of the bolts 21 are screwed into threaded holes 19*b* formed in the housing 19, respectively. The disc spring 20 is elastically deformed by tightening each one of the bolts 21. The elastic force due to this deformation results in the preload acting along the direction of thrust on the shaft 7 via the bearing 8.

A front discharge chamber 23 is defined between the front housing 18 and the plate 3. Likewise, a rear discharge housing 24 is defined between the rear housing 19 and the plate 4. The compression chambers Pa and Pb communicate with the discharge chambers 23 and 24, via discharge ports 3*c* and 4*c* formed in the plates 3 and 4, respectively. Flapper type discharge valves 31 and 32 open or close the ports 3*c* and 4*c*, respectively. Retainers 33 and 34 regulate opening amount of the discharge valves 31 and 32, respectively. The valve 31 and retainer 33 are secured to the plate 3 by a bolt 35. Similarly, the valve 32 and retainer 34 are secured to the plate 4 by a bolt 36. The discharge chamber 23 communicates to the external discharge passage for the refrigerant gas (not shown), via an exhaust passage 25.

A lip type seal 26 is disposed between the shaft 7 and the housing 18. The seal 26 prevents the refrigerant gas from leaking along the peripheral surface of the shaft 7 from the discharge chamber 23 to outside of the compressor.

Rotary valves 27 and 28 are accommodated in the bores 1*a* and 2*a*, respectively. The valves 27 and 28 are unrotatably fitted on the opposed step portions 7*a* and 7*b* of the shaft 7. The valves 27 and 28 are integrally rotatable with the shaft 7. Seal rings 39 and 40 are disposed between the shaft 7 and valve 27, and the shaft and valve 28, respectively. Discharge pressure of the refrigerant gas is applied to the outer end portions of the discharge chambers 23 and 24, respectively. Suction pressure of the refrigerant gas is applied to the distal portions of the crank case 11. The discharge chambers 23 and 24 where the discharge pressure is applied, are isolated from the crank case 11 where the suction pressure is applied, by the valves 27 and 28.

Suction passages 29 and 30 are formed in the valves 27 and 28, respectively. The crank case 11 communicates with the accommodating bores 1*a* and 2*a* through the suction passages 29 and 30, respectively.

As shown in FIG. 2, a plurality of suction ports 1*b* are formed on the inner peripheral surface of the bore 1*a*. The number of the ports 1*a* equally corresponds to that of the bores 13 and 13A. The ports 1*b* are equiangularly disposed around the bore 1*a*. Each one of the ports 1*b* always communicates with each one of the bores 13 and 13A. Each one of the ports 1*b* opens toward the outer peripheral surface of the rotary valve 27. Each one of the ports 1*b* selectively communicates with the suction passage 29 of the valve 27, as a discharge port 29*a* formed in the passage 29 is moved along the circular orbit when the shaft 7 is rotated. Consequently, the crank case 11 communicates with each one of the bores 13 and 13A.

Likewise, as shown in FIG. 3, suction ports 2*b* are formed on the inner peripheral surface of the bore 2*a*. The number of the ports 2*b* equally corresponds to that of the bores 14 and 14A. The ports 2*b* are equiangularly disposed around the bore 2*a*. Each one of the ports 2*b* always communicates with each one of the bores 14 and 14A. Each one of the ports 2*b* opens toward the outer peripheral surface of the rotary valve 28. Each one of the ports 2*b* selectively communicates with the passage 30 of the valve 28, as a discharge port 31*a* of the passage 30 is moved along the circular orbit according to the rotation of the shaft 7.

As shown in FIGS. 1 through 3, the piston head 15A is at the top dead center in one bore 13A, and at the bottom dead center in the other bore 14A. The rotary shaft 7 rotates along the direction indicated by arrow Q. As shown in FIG. 2, the discharge port 29*a* of the suction passage 29 is about to communicate with the suction port 1*b* of the bore 13A. As shown in FIG. 3, the discharge port 30*a* of the passage 30 has just isolated from the discharge port 2*b* of the bore 14A. When the piston is in the suction stroke in the bore 13A, the piston is in the discharge stroke in the bore 14A. More specifically, when the piston head 15A moves from the top dead center to the bottom dead center in the bore 13A, simultaneously the piston head 15A moves from the bottom dead center to the top dead center in the bore 14A.

Accordingly, when the piston in the bore 13A is in the suction stroke, the suction passage is communicated with the compression chamber Pa. Therefore, the refrigerant gas in the crank case 11 is sucked into the compression chamber Pa through the suction passage 29. At the same time, when the piston in the bore 14A is in the discharge stroke, the suction passage 30 is disconnected from the associate compression chamber Pb. Therefore, the refrigerant gas in the compression chamber Pb is discharged into the discharge chamber 24 through the valve 32 and port 4*c*.

The suction and discharge of the refrigerant gas are, likewise, carried out in the other paired bores 13 and 14 in accordance with the rotation of the rotary shaft 7, respectively.

The front end portion of the shaft 7 protrudes beyond the front housing 18 to outside of the compressor, and the rear end portion thereof is exposed in the rear discharge chamber 24. A discharge passage 37 formed in the shaft 7 extends along the longitudinal direction thereof. The passage 37 opens toward the discharge chamber 24. The shaft 7 includes feed ports 38 which are formed within the area surrounded by the front discharge chamber 23. The ports 38 communicate the discharge chamber 23 with the discharge passage 37. Therefore, the front and rear discharge chambers 23 and 24 are communicated with each other by way of the discharge passage 37. As a result, the refrigerant gas in the discharge chamber 24 is discharged into the other discharge chamber 23 by way of the discharge passage 37.

Figure 7:
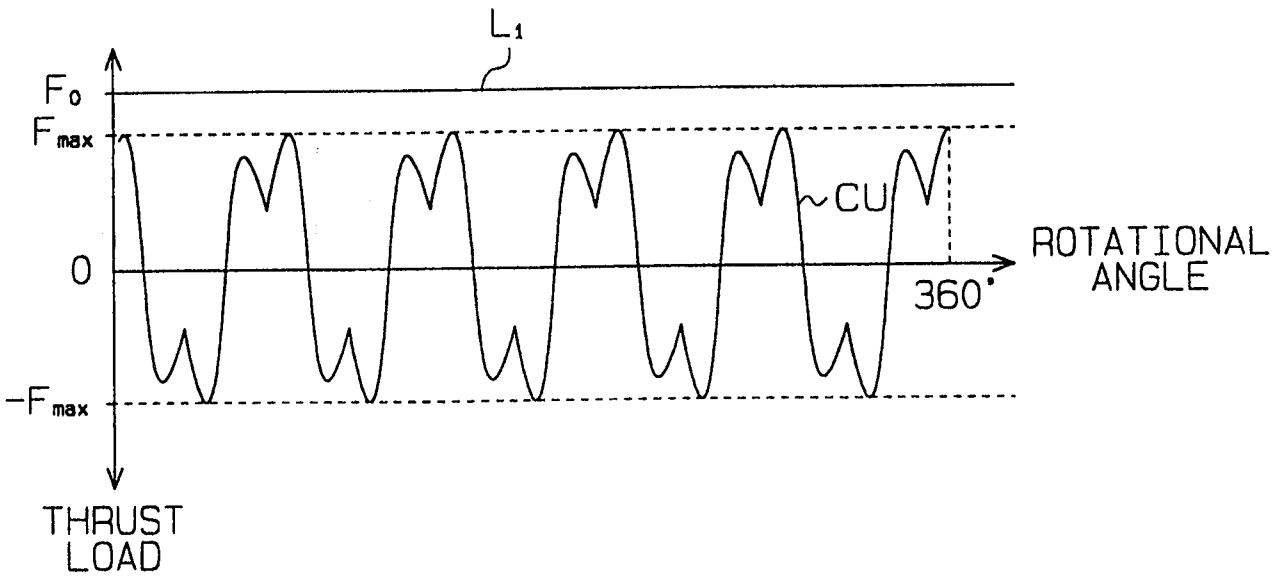
FIG. 7 is a graph describing the preload changing according to the rotational angle of the rotary shaft.

In the compressor having the above structure, the thrust load applied to the shaft 7 varies along a curved line CU in FIG. 7. In the curve CU, the plus side of the ordinate axis indicates the thrust load acting along the direction from the front housing 18 to the rear housing 19. The curved line CU in the negative side of the ordinate axis indicates the thrust load acting along the direction from the rear housing 19 to the front housing 18. The straight line $L_1$ indicates the preload applied on the shaft 7 according to the magnitude of deformation of the spring 20. The preload ($+F_0$) indicated by the line $L_1$ counteracts against the thrust load acting along the direction from the rear side to the front side. The spring 20 is formed to withstand even when the preload $F_0$ slightly exceeds the maximum value Fmax of the thrust load. As the preload $F_0$ is set in this manner, the clearance in the thrust direction between the end surfaces of the step portions 7*a* and the protrusions 18*a*, and the step portions 7*b* and the protrusions 19*a* is eliminated. In other words, lash is not generated. As a result, the generation of the noise and/or vibration is prevented.

The preload is determined according to the characteristic and the deformation magnitude of the spring 20. The deformation magnitude of the spring 20 is influenced by the dimension deviation due to assembling of the blocks 1 and 2, plates 3 and 4, housings 18 and 19 and disc spring 20. When the variation is not generated in the deviation during the installation, the preload in every compressor becomes approximately identical. When the variation is generated in the deviation, the preload in every compressor differs. In this case, as the preferable number of shims are disposed between the protrusions 18*a* and the spring 20, or between the outer race 9*a* of the bearing 9 and the protrusions 19*a*, the preferable magnitude of preload can be applied. Therefore, the preload applied to the rotary shaft can be stably controlled in the compressor. Thus, the quality of the compressor can be well kept up by eliminating the abnormal noise and vibration.

Further, the weight of the compressor is reduced by employing the rotary shaft made of steel iron and the cylinder block made of family of aluminum alloy. When the compressor is operated with a high compression ratio, the temperature of refrigerant gas compressed in the compression chamber rises. Consequently, the temperature of the cylinder blocks 13, 13A, 14 and 14A likewise rise. The magnitude of thermal expansion of the cylinder blocks 1 and 2, which is made of an aluminum alloy, along the thrust direction becomes greater than that of the rotary shaft 7, which is made of steel iron. Therefore, the positions of the protrusions 18*a* of the front housing 18, which urge the disc spring 20, are shifted frontward (to the left direction) by micrometers as shown in FIG. 1. The magnitude of thermal expansion increases as the temperature of the cylinder blocks 1 and 2 increases. However, in this embodiment, as the cylinder blocks 1 and 2, front housing 18 and rear housing 19 are tightened by a plurality of bolts 21, the magnitude of thermal expansion along the thrust direction is reduced. Therefore, the preload along the thrust direction applied to the shaft 7 caused by the spring 20 is preferably maintained, such that generation of vibration and noise during the operation of the compressor is reduced.

Figure 6:
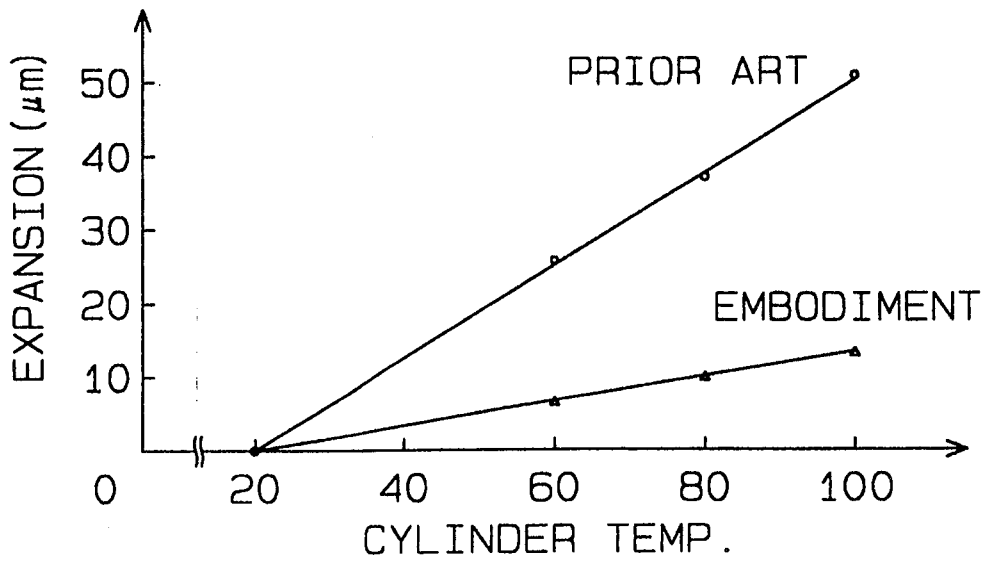
FIG. 6 is a graph showing the correlation between thermal expansion and temperature of a cylinder block.

Assume the cylinder blocks 1 and front housing 18, and cylinder block 2 and rear housing 19 are tightened by separate bolts, respectively. In this case as shown in FIG. 6, when the temperature of the cylinder blocks 1 and 2 increases from 20° C. to 100° C., the magnitude of the thermal expansion along the thrust direction becomes approximately 50 μm. According to the first embodiment, the magnitude of the thermal expansion along the thrust direction becomes approximately 12 μm within the similar temperature range. As a result, the magnitude of the thermal expansion becomes approximately one quarter of that caused in the prior art. Therefore, the preload applied to the shaft 7 along the thrust direction by the spring 20 will not be much lowered even when the temperature of the cylinder blocks 1 and 2 rises.

Further, in the first embodiment, the preload of the spring 20 is no longer required to be set at a higher value, for considering the decrease of preload of the spring 20 in a high temperature. The preload applied to the shaft 7 along the thrust direction is minimized. Therefore, the durability of tapered roller bearings 8 and 9 is extended. Rotational torque of the shaft 7 under the operation with slow rotation and low compression ratio is reduced, such that the loss of the energy is suppressed.

The compressor receives the radial load and thrust load acting on the shaft 7, via the bearings 8 and 9. Therefore, the number of bearings for the rotary shaft 7 is reduced to a half of the number which the conventional compressor requires. Therefore, the assembling process of a compressor can be simplified.

Since the rotary valves 27 and 28 are employed as suction valves, the following advantages are achieved.

When the flapper type suction valve is employed, lubricant oil increases adsorptive force between the valve and the closely spaced associated surface. Consequently, actuating timing for the suction valve is delayed by this adsorptive force. This delay of timing and the suction resistance originated in the elastic force reduces the compression efficiency. However, when the forcibly rotated rotary valves 27 and 28 are employed, the suction resistance originated in the adsorptive force of lubricant oil is avoided. Furthermore, the resiliency due to the suction valve is eliminated. Therefore, when the internal pressure in the compression chambers Pa and Pb slightly drops below the suction pressure within the crank case 11, the refrigerant gas immediately flows into the compression chambers Pa and Pb. Therefore, the compression efficiency of the rotary valves 27 and 28 is significantly increased compared to that of the flapper type suction valve.

Each one of the suction passages in the conventional cylinder blocks is disposed at the associate space between the adjacent cylinder bores. Such arrangement of the suction passages reduces the strength of the cylinder blocks. The discharge passage is also disposed in the cylinder blocks. Therefore, the spaces between the cylinder bores should be increased in order to secure the strength of the cylinder blocks. However, since the suction passages and discharge passage are disposed in the cylinder blocks, the spaces between the adjacent bores can not be reduced.

On the other hand, in the swash plate type compressor according to this embodiment, the sucked refrigerant gas in the crank case 11 is further sucked into the compression chambers Pa and Pb through the suction passages 29 and 30. The compressor according to this embodiment can eliminate a plurality of suction passages in the cylinder blocks which are required in the conventional swash plate type compressor. Further, the refrigerant gas in the discharge chamber 24 is led to the exhaust passage 25 through the discharge passage 37 formed in the rotary shaft 7. Therefore, the compressor according to this embodiment can eliminate the discharge passage disposed in the cylinder blocks, which the conventional block required. Since the suction passages and discharge passage are eliminated from the cylinder blocks 1 and 2, the spaces between the cylinder bores 13, 13A, 14 and 14A can be reduced, respectively. The reduction of arranged spaces between the adjacent cylinder bores contributes to decrease the dimensional radius of the cylinder blocks. Therefore, the diameter of the entire cylinder blocks 1 and 2 can be reduced. As a result, the down-sizing and light weight of the entire compressor can be achieved.

Since the rotary valves 27 and 28 are employed, the suction chambers defined in the front and rear housing which the conventional compressor requires can be eliminated. In the place of the suction chambers, the tapered roller bearings 8 and 9 can be disposed in the front and rear housings 18 and 19, respectively. That is, the spaces for disposing the bearings for receiving the shaft are no longer required due to the employment of the rotary valves 27 and 28. Therefore, the down-sizing of the compressor can be achieved.

Further, when the internal pressure in the compression chambers Pa and Pb drops below that in the crank case 11, the refrigerant gas in the crank case 11 is sucked into the compression chambers P, Pa and Pb. When the passage resistance of the refrigerant gas in the flow passage from the crank case 11 to the compression chambers P, Pa and Pb, that is, when the suction resistance is high, the loss of pressure increases. Therefore, the compression efficiency is lowered. Since the rotary valves 27 and 28 are employed, the flow distance of refrigerant gas from the crank case 11 to the compression chambers P, Pa and Pb is shortened. Therefore, the suction resistance is reduced compared to that of the conventional compressor. As a result, the loss of suction is minimized, and the compression efficiency is increased.

Figure 8:
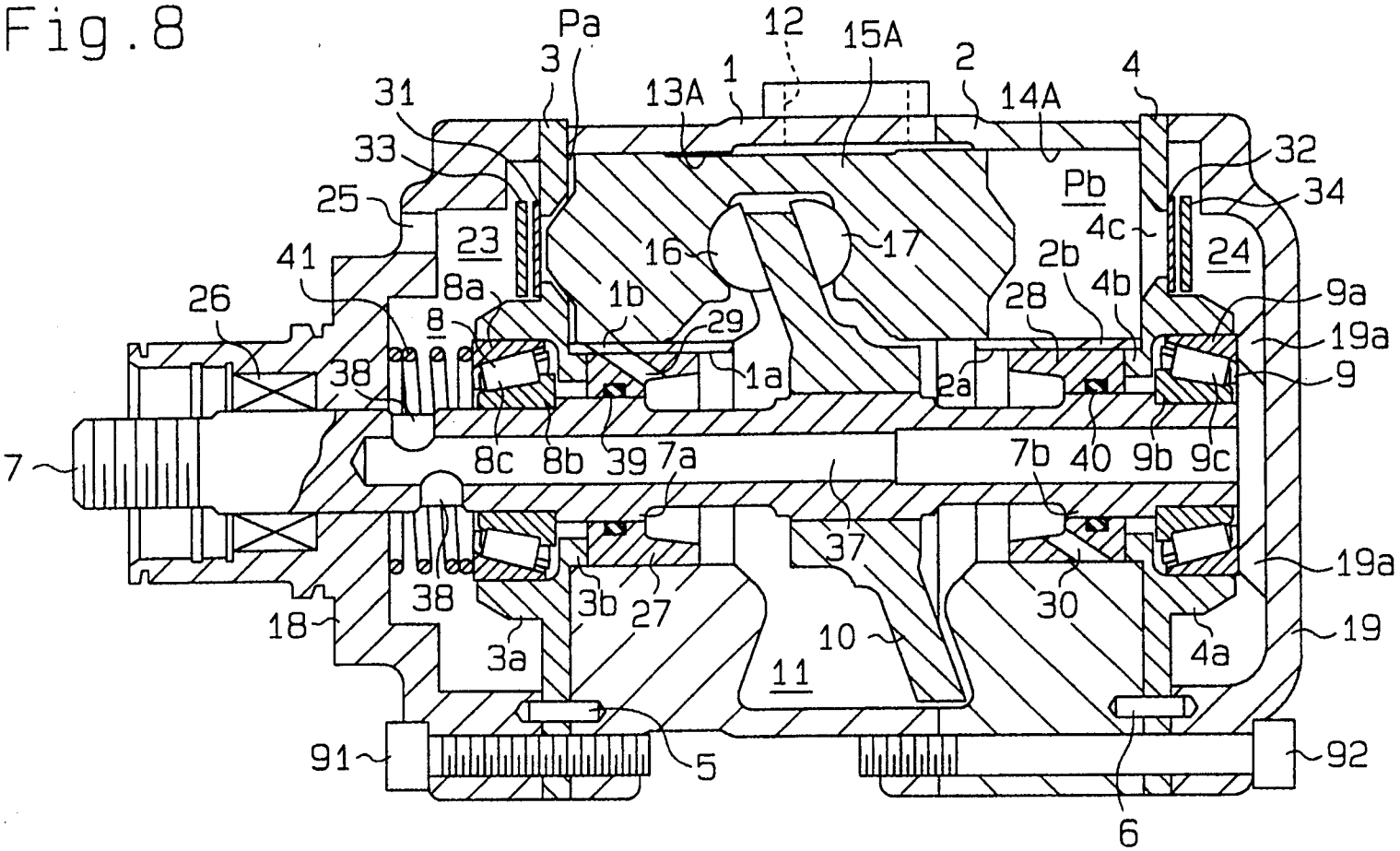
FIG. 8 is a cross sectional view illustrating a swash plate type compressor according to the second embodiment of the present invention.

FIG. 8 shows the second embodiment according the present invention. According to the second embodiment, the arrangement of assembling the front and rear housings, and the structure of the spring for applying the preload differ from those of the first embodiment.

The cylinder block 1, valve plate 3 and front housing 18 are tightened together by a bolt 91. The cylinder blocks 1 and 2, valve plate 4 and rear housing 19 are tightened together by a bolt 92.

A compression spring 41 for applying the preload on the shaft 7 along the thrust direction is employed. Employing the spring 41 has a disadvantage of wide fitting space, compared to the ring shaped flat spring. However, as the characteristic of every compression spring becomes consistent, the variation of preload applied to the shaft 7 is eliminated. The preload in the swash plate type compressor is further stabilized.

The third embodiment according to the present invention will now be described, referring to FIGS. 9 and 10.

Figure 9:
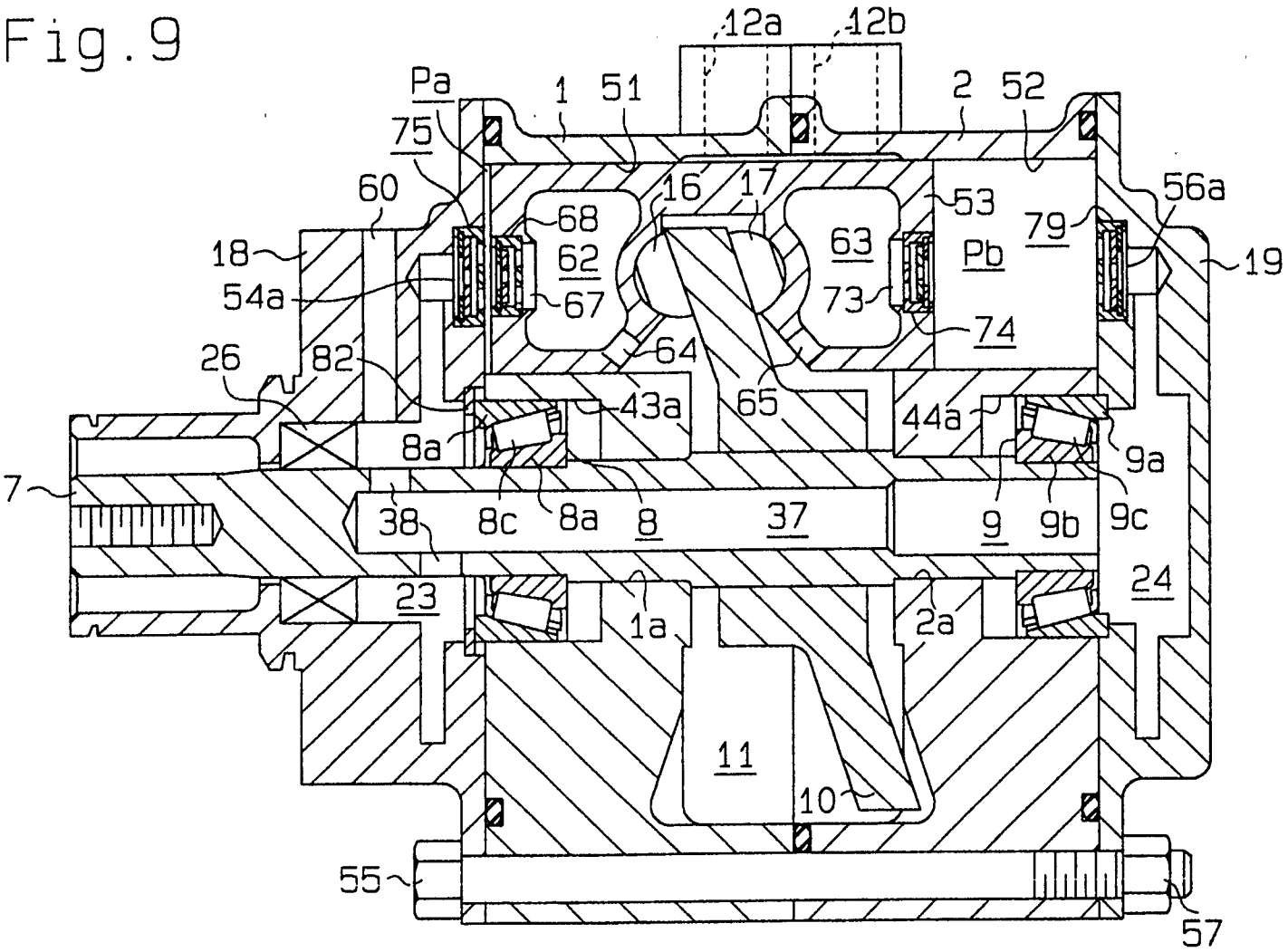
FIG. 9 is a cross sectional view illustrating a swash plate type compressor according to the third embodiment of the present invention.

As shown in FIG. 9, a pair of front and rear cylinder blocks 1 and 2 are connected together by means of a through bolt 55 and a nut 57. The cylinder blocks 1 and 2 include receiving recesses 43*a* and 44*a* which are disposed in the outer end sides thereof, respectively. The rotary shaft 7 is rotatably supported by the blocks 1 and 2, via the tapered roller bearings 8 and 9. The bearings 8 and 9 are accommodated in the recesses 43*a* and 44*a*, respectively. The outer races 8*a* and 9*a* of the bearings 8 and 9 are slidably fitted into the inner peripheral surfaces of the recesses 43*a* and 44*a*, respectively. Inner races 46*b* and 47*b* for clamping rollers 46*c* and 47*c* together with the outer races 8*a* and 9*a* are securely mounted on a shaft 45.

Suction ports 12*a* and 12*b* are formed in the blocks 1 and 2, respectively. The suction port 12*a* communicates to the crank case 11. The suction ports 12*a* and 12*b* communicate to the suction passage disposed externally of the refrigerant gas (not shown).

Figure 10:
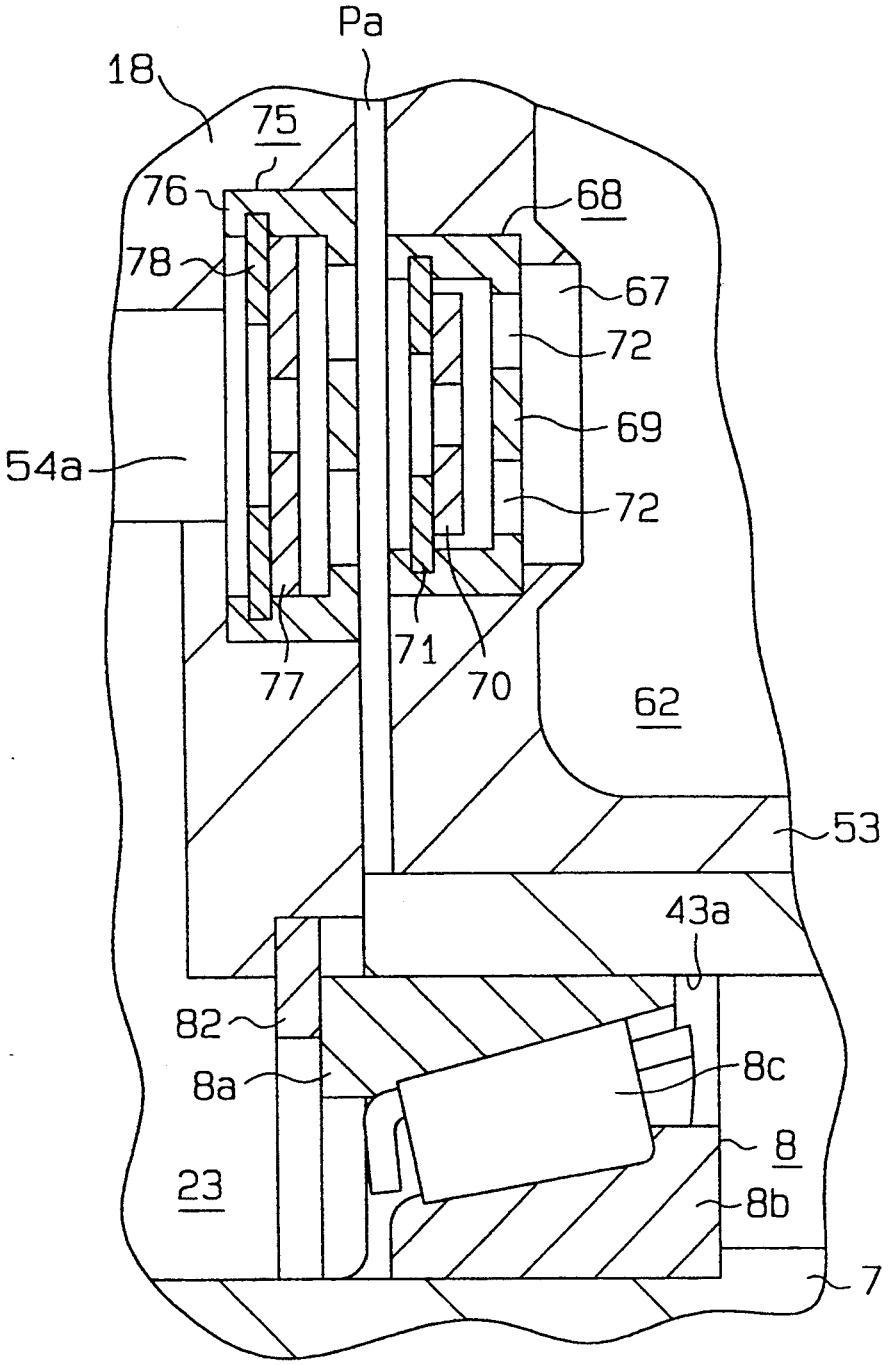
FIG. 10 is an enlarged cross sectional view illustrating portions of FIG. 9.
Figure 11:
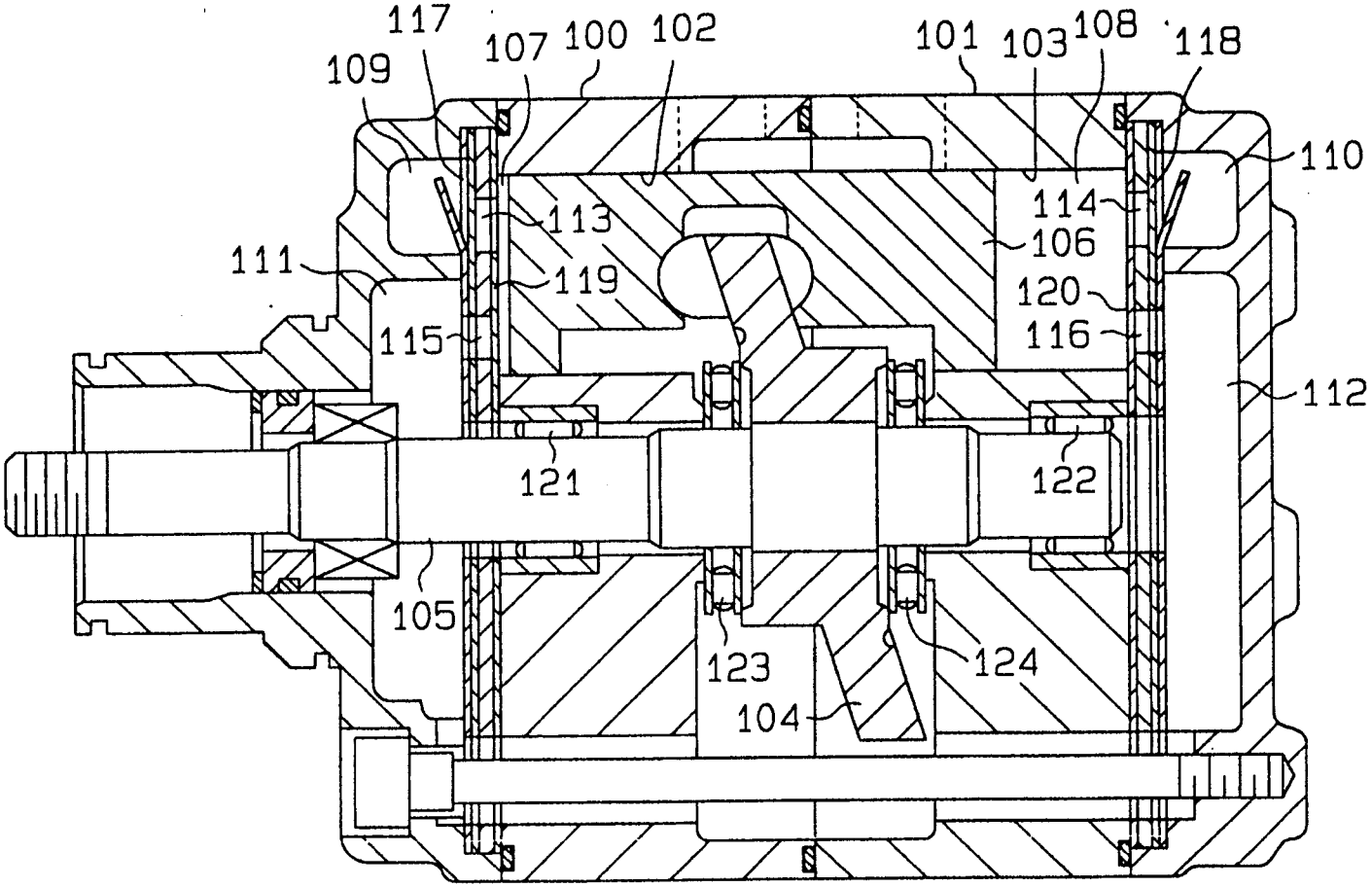
Fig. 11 (PRIOR ART)
FIG. 11 is a cross sectional view illustrating a conventional swash plate type compressor.
Figure 12:
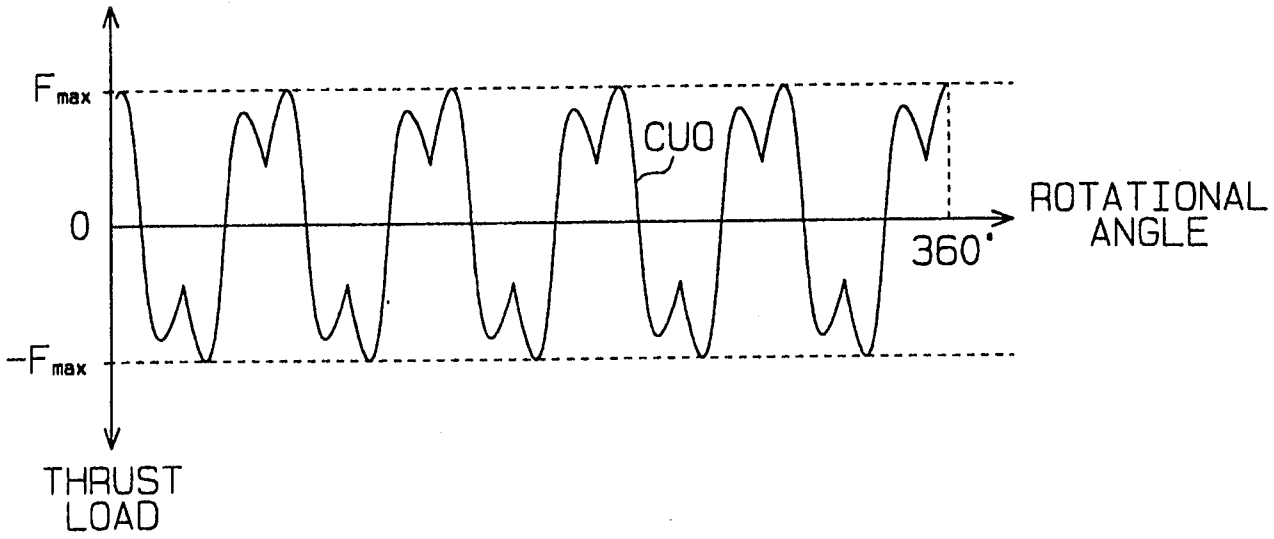
Fig. 12 (PRIOR ART)
FIG. 12 is a graph describing the thrust load changing according to the rotational angle of the rotary shaft for the conventional swash plate type compressor of FIG. 11.

As shown in FIG. 10, a plurality of cylinder bores 51 and 52 are formed in the blocks 1 and 2, respectively. The bores 51 and 52 are equidistantly located from the shaft 7 and equiangularly disposed around the shaft 7. As shown in FIG. 9, a double headed piston 53 is reciprocally movably accommodated in a paired front and rear bores 51 and 52 (five pairs in this embodiment). The compression chambers Pa and Pb are formed in the bores 51 and 52 which are defined by the piston 53, respectively.

The front and rear housings 18 and 19 are connected to the blocks 1 and 2 by tightening the bolt 55 with the nut 57. A ring shaped flat spring 82 for applying the preload is disposed between the housing 18 and the outer race 8*a* of bearing 8. The outer peripheral edge portion of the spring 82 abuts against the housing 18. The inner peripheral edge portion of the spring 82 abuts against the outer race 8*a* of the bearing 8. The outer race 9*a* of the bearing 9 abuts against the housing 19. The spring 82 is resiliently deformed by tightening the bolt 55, similar to the disc spring in the first embodiment.

The discharge chambers 23 and 24 disposed in the housings 18 and 19 communicate to the bores 51 and 52, via discharge ports 54*a* and 56*a*, respectively.

A pair of suction chambers 62 and 63 are formed in the piston 53. The suction chambers 62 and 63 communicate to the crank case 11, via flow ports 64 and 65 disposed in the piston 53. The refrigerant gas in the crank case 11 can be flowed into the suction chambers 62 and 63, via the flow ports 64 and 65.

As shown in FIG. 10, a suction port 67 is formed through the distal surface of front-side head of the piston 53. A suction valve 68 is provided on the suction port 67. The suction valve 68 is formed with a valve seat 69 fitted into the distal surface of the head, disc shaped float valve 70 accommodated in the seat 69, and cir-clip type retainer 71 to hold the float valve 70 within the seat 69. A through hole 72 is formed in the seat 69. The float valve 70 opens or closes the hole 72.

As shown in FIG. 9, a suction port 73 is formed through the distal surface of rear-side head of the piston 53. A suction valve 74 is provided on the suction port 73, similar to the suction valve 68.

A discharge valve 75 is provided on a discharge port 54*a*. As shown in FIG. 10, the discharge valve 75 is formed with a valve seat 76 fitted into the housing 18, a disc shaped float valve 77 accommodated in the seat 76, and a retainer 78 to hold the float 77 within the seat 76. The shapes of the valve seat 76, float valve 77 and retainer 78 are similar to those of the seat 69, float valve 70 and retainer 71, respectively. A discharge valve 79 is provided on a discharge port 56*a*, similar to the discharge valve 75.

When the piston 53 is in the reverse stroke shifting toward the bore 52 side, the refrigerant gas in the suction chamber 62 is sucked into the compression chamber Pa, while the gas is urging the float valve 70 away. The magnitude of opening of the float valve 70 is controlled by abutting against the retainer 71. When the piston 53 is in the forward stroke to the bore 51 side, the refrigerant gas in the compression chamber Pa is discharged into the compression chamber 58 with urging the float valve 77 away. The opening magnitude of the valve 77 is controlled by the retainer 78 which abuts against the retainer 78.

In the side of the compression chamber Pb defined between the piston 53 and the rear housing 19, the suction and discharge operations of the refrigerant gas are carried out similarly, by the operations of the suction valve 74 and discharge valve 79.

Similar to the first embodiment, a front distal end portion of the shaft 7 protrudes beyond the front housing 18 to the outside of the compressor. A rear distal portion of the shaft 7 is exposed in the rear discharge chamber 23 of the rear housing 19. The discharge passage 37 extending along the longitudinal direction of the shaft 7 opens to the discharge chamber 23. The deviation port 38 formed in the shaft 7 communicates to the discharge chamber 24 and the discharge passage 37, such that the refrigerant gas in the discharge chamber 24 is fed into the discharge chamber 23, via the passage 37 and deviation port 38. The refrigerant gas in the discharge chamber 23 is discharged into the external discharge passage through the exhaust passage 25.

According to the third embodiment, when the spring 82 is resiliently deformed, the resiliency is applied as a preload on the shaft 7, via the tapered roller bearings 8 and 9. Therefore, the preload applied on the shaft similar to the first embodiment can be securely controlled. The quality of compressor relating to the generation of noise and vibration can be stabilized.

According to this embodiment, the refrigerant gas in the crank case 11 is sucked into the compression chambers Pa and Pb through the suction chambers 62 and 63 in the piston 53. Therefore, the compressor according to this embodiment can eliminate a plurality of suction passages, which are disposed in the cylinder blocks of the conventional swash plate type compressor. The refrigerant gas in the discharge chamber 24 is led into the exhaust passage 25 through the discharge passage 37 formed in the shaft 7. Therefore, in this embodiment, the discharge passage formed in the cylinder blocks can be eliminated similar to the first embodiment, such that the arrangement radios can be reduced. The down-sizing and light weight of the entire compressor can be achieved.

Further, according to the third embodiment, suction chambers 62 and 63 formed in the piston 53 replace the suction chambers formed at the front and rear portions of the cylinder blocks in the conventional compressor, respectively. Such alternate locations of the suction chambers can contribute to the down-sizing of the entire compressor.

Further, according to the third embodiment, the cylinder blocks 1 and 2, front housing 18 and rear housing 19 are connected together by means of tightening the plurality of through bolts 55 and the associate nuts 57. Therefore, the magnitude of thermal expansion along the thrust direction can be reduced. As a result, the preload applied on the rotary shaft 7 along the thrust direction which is originated in the spring 82, can be preferably maintained, such that the generation of vibration and abnormal noise during the operation of the compressor can be significantly suppressed.

Although only three embodiments of the present invention have been described herein, it should be apparent to those skilled in the art that the present invention may be embodied in many other specific forms without departing from the spirit or scope of the invention.

Particularly, it should be understood that following mode is to be applied. For example, in the first and third embodiments, the springs 20 and 82 can be disposed between the rear housing 19 and the outer race **9*a* of the tapered roller bearing 9**.

Therefore, the present examples and embodiments are to be considered as illustrative and not restrictive and the invention is not to be limited to the details giving herein, but may be modified within the scope of the appended claims.

What is claimed is:

1. A swash plate type compressor having a cylinder block with opposite ends and with paired bores communicating, respectively, with said opposite ends; a front and a rear housing closing, respectively, said opposite ends of said cylinder block; a front discharge chamber in the front housing and a rear discharge chamber in the rear housing in communication, respectively, with said paired bores; a swash plate mounted on a rotary shaft having opposite ends respectively extending to said front and rear housings; and double headed type pistons operably connected with said swash plate, each piston having a pair of piston heads disposed for reciprocating motion each in an associated one of said bores in accordance with rotation of said swash plate for compressing refrigerant gas; said compressor further comprising:

a pair of tapered roller bearings disposed respectively at said opposite ends of said shaft for rotatably supporting said rotary shaft for receiving radial loads acting on said rotary shaft during rotation thereof, and for receiving thrust loads acting on said rotary shaft due to compressed gas acting on said piston heads, said bearings each having an inner race, an outer race, and a plurality of tapered rollers rotatably disposed about and between said outer and inner races, the larger diameter ends of the rollers in one bearing facing the larger diameter ends of the rollers in the other bearing, said races of said bearings having conical surface portions engaged by the respective rollers with said respective rollers arranged to move along a circular orbit in contact with said conical surface portions;

supporting means for supporting each of said bearings with a sliding fit in the axial direction relative to said shaft; and spring means including at least a disk spring disposed between at least one of said roller bearings and the adjacent housing for biasing the outer race of said one roller bearing to apply a preload to said rotary shaft in the axial direction relative to said shaft.

2. A swash plate type compressor as set forth in claim 1 further including:

a first projection abutting against said disk spring from said adjacent housing; and a second projection in the other of said housings abutting against said outer race of the adjacent bearing.

3. A swash plate type compressor as set forth in claim 1, wherein said supporting means includes a pair of recesses formed with the ends of the cylinder block, and receiving the outer races in the slidable manner, respectively.

4. A swash plate type compressor as set forth in claim 1, further including a rotary valve mounted on the rotary shaft, wherein said rotary valve has a first portion opening toward a crank case, and a second portion having a suction passage for communication with said cylinder bores in accordance with the rotation of the rotary valve.

5. A swash plate type compressor as set forth in claim 1, wherein each piston head includes:

a suction chamber communicating to a crank case;

a suction port formed on an end surface of the piston head; and a suction valve for opening said suction port.

6. A swash plate type compressor having a cylinder block with opposite ends and with paired bores communicating, respectively, with said opposite ends; a front and a rear housing closing, respectively, said opposite ends of said cylinder block; a front discharge chamber in the front housing and a rear discharge chamber in the rear housing in communication, respectively, with said paired bores; a swash plate mounted on a rotary shaft having opposite ends respectively extending to said front and rear housings; and double headed type pistons operably connected with said swash plate, each piston having a pair of piston heads disposed for reciprocating motion each in an associated one of said bores in accordance with rotation of said swash plate for compressing refrigerant gas; said compressor further comprising:

a pair of tapered roller bearings disposed respectively at said opposite ends of said shaft for rotatably supporting said rotary shaft for receiving radial loads acting on said rotary shaft during rotation thereof, and for receiving thrust loads acting on said rotary shaft due to compressed gas acting on said piston heads, said bearings each having an inner race, an outer race, and a plurality of tapered rollers rotatably disposed about and between said outer and inner races, the larger diameter ends of the rollers in one bearing facing the larger diameter ends of the rollers in the other bearing, said races of said bearings having conical surface portions engaged by the respective rollers with said respective rollers arranged to move along a circular orbit in contact with said conical surface portions;

supporting means for supporting each of said bearings with a sliding fit in the axial direction relative to said shaft;

a disk spring disposed between at least one of said roller bearings and the adjacent housing for biasing the outer race of said one roller bearing to apply a preload to said rotary shaft in the axial direction relative to said shaft; and a plurality of through bolts for tightening said cylinder block, said front housing and said rear housing to one another in the axial direction relative to said shaft.

7. A swash plate type compressor as set forth in claim 6, wherein said supporting means includes a pair of recesses formed with the ends of the cylinder block, and receiving the outer races in the slidable manner, respectively.

8. A swash plate type compressor as set forth in claim 6, further including a rotary valve mounted on the rotary shaft, wherein said rotary valve has a first portion opening toward a crank case, and a second portion having a suction passage for communication with said cylinder bores in accordance with the rotation of the rotary valve.

9. A swash plate type compressor having a cylinder block with opposite ends and with paired bores communicating, respectively, with said opposite ends; a front and a rear housing closing, respectively, said opposite ends of said cylinder block; a front discharge chamber in the front housing and a rear discharge chamber in the rear housing in communication, respectively, with said paired bores; a swash plate mounted on a rotary shaft having opposite ends respectively extending to said front and rear housings; and double headed type pistons operably connected with said swash plate, each piston having a pair of piston heads disposed for reciprocating motion each in an associated one of said bores in accordance with rotation of said swash plate for compressing refrigerant gas, said compressor further comprising:

a pair of tapered roller bearings disposed respectively at said opposite ends of said shaft for rotatably supporting said rotary shaft for receiving radial loads acting on said rotary shaft during rotation thereof, and for receiving thrust loads acting on said rotary shaft due to compressed gas acting on said piston heads, said bearings each having an inner race, an outer race, and a plurality of tapered rollers rotatably disposed about and between said outer and inner races, the larger diameter ends of the rollers in one bearing facing the larger diameter ends of the rollers in the other bearing, said races of said bearings having conical surface portions engaged by the respective rollers with said respective rollers arranged to move along a circular orbit in contact with said conical surface portions;

supporting means for supporting each of said bearings with a sliding fit in the axial direction relative to said shaft;

a disk spring disposed between at least one of said roller bearings and the adjacent housing for biasing the outer race of said one roller bearing to apply a preload to said rotary shaft in the axial direction relative to said shaft;

a plurality of through bolts for tightening said cylinder block, said front housing and said rear housing to one another in the axial direction relative to said shaft; and a rotary valve mounted on said rotary shaft, said rotary valve having a first portion opening toward a crank case formed within said cylinder block and a second portion having a suction passage for communication with said bores in accordance with the rotation of said rotary valve.

10. A swash plate type compressor having a cylinder block with opposite ends and with paired bores communicating, respectively, with said opposite ends; a front and a rear housing closing, respectively, said opposite ends of said cylinder block; a front discharge chamber in the front housing and a rear discharge chamber in the rear housing in communication, respectively, with said paired bores; a swash plate mounted on a rotary shaft having opposite ends respectively extending to said front and rear housings; and double headed type pistons operably connected with said swash plate, each piston having a pair of piston heads disposed for reciprocating motion each in an associated one of said bores in accordance with rotation of said swash plate for compressing refrigerant gas; said compressor further comprising:

a pair of tapered roller bearings disposed respectively at said opposite ends of said shaft for rotatably supporting said rotary shaft for receiving radial loads acting on said rotary shaft during rotation thereof, and for receiving thrust loads acting on said rotary shaft due to compressed gas acting on said piston heads, said bearings each having an inner race, an outer race, and a plurality of tapered rollers rotatably disposed about and between said outer and inner races, the larger diameter ends of the rollers in one bearing facing the larger diameter ends of the rollers in the other bearing, said races of said bearings having conical surface portions engaged by the respective rollers with said respective rollers arranged to move along a circular orbit in contact with said conical surface portions;

supporting means for supporting said bearings, said supporting means including a pair of valve plates, a pair of sleeves formed integral with the valve plates which sleeves accomodate the outer races of said bearings with a sliding fit; and spring means for applying a preload to the rotary shaft by way of said bearings in the axial direction thereof.

11. A swash plate type compressor as set forth in claim 10, wherein said spring means includes a disk spring for biasing the outer race of one of said tapered roller bearings.

12. A swash plate type compressor as set forth in claim 11 further including:

a first projection abutting against said disk spring from said adjacent housing; and a second projection in the other of said housings abutting against said outer race of the adjacent bearing.

* * * * *